US005806141A

United States Patent [19]

Kolisch

[11] Patent Number: 5,806,141

[45] Date of Patent: Sep. 15, 1998

[54] CURTAIN SUSPENSION DEVICE

[76] Inventor: John H. Kolisch, 578 Vance St., Lakewood, Colo. 80226

[21] Appl. No.: 813,406

[22] Filed: Mar. 10, 1997

[51] Int. Cl.[6] ..... E05D 13/00; E05D 15/00

[52] U.S. Cl. ..... 16/87.2; 16/87.6 R; 16/87.8

[58] Field of Search ..... 16/87.2, 87.6 R, 16/87.8; 160/330

[56] References Cited

U.S. PATENT DOCUMENTS

| | | | |
|---|---|---|---|
| 649,715 | 5/1900 | Beulwitz | 16/87.2 |
| 1,244,748 | 10/1917 | Larson | 16/87.2 |
| 2,320,003 | 5/1943 | Madan | 16/87.8 |
| 3,772,734 | 11/1973 | Kimel | 16/87.2 |
| 4,010,503 | 3/1977 | Denton | 16/87.2 |
| 5,367,742 | 11/1994 | Bindman | 16/87.2 |

FOREIGN PATENT DOCUMENTS

| | | | |
|---|---|---|---|
| 11398 | of 1885 | United Kingdom | 16/87.2 |

*Primary Examiner*—Randolph A. Reese
*Assistant Examiner*—Donald M. Gurley
*Attorney, Agent, or Firm*—Michael A. Capraro

[57] ABSTRACT

A curtain suspension device for suspending curtains, drapes and other sheet-like material from a support bar or rod comprised of a generally circular curved member having an inner surface, an end and an opposite, the end fixedly attached to a first gripping member and the opposite end fixedly attached to a second gripping member. At least one gripping protrusion and at least one gripping protrusion receiving notch are opposingly, alternately and concentrically formed on the gripping surface of the first gripping member and on the gripping surface of the second gripping member. A friction reducing element is formed on the inner surface of the curved member minimizing frictional resistance as the curtain suspension device is moved along a prior art support bar or rod.

21 Claims, 5 Drawing Sheets

CURTAIN SUSPENSION DEVICE

BACKGROUND OF THE INVENTION

This invention relates generally to devices utilized to suspend curtains, drapes and other sheet-like material from a support bar or rod to provide a barrier or for decorative purposes and more specifically to a new and novel curtain suspension device. The new and novel curtain suspension device is designed to prevent tearing, ripping, splitting, and undue wear of suspended curtains, drapes or other sheet-like materials and to move easily and freely along a support bar or rod.

Prior art curtains, drapes and other sheet-like material are suspended from a support bar or rod to provide a barrier, such as a shower curtain used to prevent water from escaping the confines of a shower stall, or for decorative purposes, such as decorative window coverings. A series of openings are generally formed near an edge of prior art curtains, drapes and other sheet-like material allowing the curtain, drape or other sheet-like material to be attached to a suspension device which encompasses and is movable along a support bar or rod which has been attached to a wall, walls or other structures and which spans an opening or area to be covered. Prior art support bars or rods are typically constructed having an inner tube designed to fit into an outer tube of a slightly larger diameter, allowing the support bar or rod to be adjusted to a desired length.

While there are a wide variety of devices that are utilized to suspend curtains, drapes and other sheet-like material from a support bar or rod, such as those illustrated in the U.S. Pat. No. 5,367,742, the U.S. Pat. No. 4,010,503 and the U.S. Pat. No. 3,772,734, design problems in these types of suspension devices present several disadvantages. Some types of prior art suspension devices rely on a hooklike or rod-like component which is inserted into an opening formed in curtains, drapes and other sheet-like material and then suspended from a support bar or rod. This places undue stress on the opening formed in the curtain, drape or other sheet-like material and causes tearing, ripping, splitting, and undue wear of the suspended curtain, drape or other sheet-like material. Other types of prior art suspension devices attempt to clamp an area around the opening or near the opening, but the design of these clamping components still causes tearing, ripping, splitting, and undue wear of the suspended curtain, drape or other sheet-like material. Additionally, prior art suspension devices are typically designed having a large area of contact with the supporting bar or rod which they encompass. Thus, they are often difficult to move along the supporting bar, especially if they are moved by pulling the curtain, drape or other sheet-like material attached to them. This problem is compounded by the fact that a raised edge results at the point where the outer tube of the support bar encompasses the inner tube of the support bar causing these types of suspension devices to hang on the resulting raised edge.

SUMMARY OF THE INVENTION

To overcome the before described considerations and problems inherent in and encountered with prior art suspension devices, there is provided by the subject invention a unique curtain suspension device that prevents tearing, ripping, splitting, and undue wear of suspended curtains, drapes or other sheet-like material. The new and novel curtain suspension device is also designed to move easily and freely along a support bar or rod which it movably encompasses and rests on. Additionally, the new and novel curtain suspension device is further designed to easily overcome obstructions inherent in adjustable support bars or rods.

A generally circular curved member having an inner surface, an end and an opposite end has a first gripping member fixedly attached to the end and a second gripping member fixedly attached to the opposite end. A friction reducing means is continuously formed on the inner surface of the curved member opposite the end and the opposite end of the curved member. The first gripping member has continuously formed thereon receiving means, the receiving means being continuously formed on an outer surface of the first gripping member. The second gripping member also has receiving means continuously formed thereon, the receiving means being continuously formed on an outer surface of the second gripping member. The first gripping member and second gripping members are semi-ellipsoidal in shape having a circular shape through a planar axis. The receiving means of the first gripping member is positioned on the outer surface of the first gripping member near the circumference of the first gripping member and the receiving means of the second gripping member is positioned on the outer surface of the second gripping member near the circumference of the second gripping member.

The receiving means on the outer surface of the first gripping member is designed to fixedly encompass the end of the curved member and the receiving means on outer surface of the second gripping member is designed to fixedly encompass the opposite end of the curved member. In the Preferred Embodiment, the end and the opposite end are fixedly attached in the receiving means using an adhesive. In another embodiment, the end and the opposite end are continuously formed with the receiving means on the first member and the receiving means on the second member, respectively.

At least one gripping means is continuously formed on the gripping surface of the first gripping member and continuously formed on the gripping surface of the second gripping member. The at least one gripping means protrudes from the gripping surface of the first gripping member and from the gripping surface of the second gripping member and is generally an inverted V-shape. The at least one gripping means is concentrically arranged on the gripping surface of the first gripping member and on the gripping surface of the second gripping member, perpendicular to and around a central axis of the first gripping member and perpendicular to and around a central axis of the second gripping member, respectively. At least one gripping means receiving notch is continuously formed in the gripping surface of the first gripping member and in the gripping surface of the second gripping member. The at least one gripping means receiving notch is also concentrically arranged on the gripping surface of the first gripping member and on the gripping surface of the second gripping member, perpendicular to and around a central axis of the first gripping member and perpendicular to and around a central axis of the second gripping member, respectively.

In the Preferred Embodiment, a plurality of at least one gripping means are concentrically spaced apart on the gripping surface of the first gripping member and on the gripping surface of the second gripping member and a plurality of at least one gripping means receiving notches are formed in the gripping surface of the first gripping member and in the gripping surface of the second gripping member between successive at least one gripping means. That is, the at least one gripping means and the at least one gripping means receiving notch are alternately arranged concentrically on the gripping surface of the first gripping member and on the gripping surface of the second gripping member.

The at least one gripping means formed on the gripping surface of the first gripping member is concentrically arranged to locate directly opposite the at least one gripping means receiving notch formed in the gripping surface of the second gripping member and the at least one gripping means formed on the gripping surface of the second gripping member is concentrically arranged to locate directly opposite the at least one gripping means receiving notch formed in the gripping surface of the first gripping member. Thus, the at least one gripping means on the first gripping member is designed to mesh with the at least one gripping means receiving notch in the second gripping member, while the at least one gripping means on the second gripping member is designed to mesh with the at least one gripping means receiving notch in the first gripping member.

In another embodiment, modified at least one gripping means and modified at least one gripping means receiving notch are continuously formed and concentrically arranged on the gripping surface of the first gripping member and continuously formed and concentrically arranged on the gripping surface of the second gripping member, similar to the concentric arrangement of the at least one gripping means and the at least one gripping means receiving notch. The modified at least one gripping means has a generally inverted U-shape. Thus, the arrangement of the modified at least one gripping means on the first gripping member is designed to mesh with the modified at least one gripping means receiving notch on the second gripping member, while the modified at least one gripping means on the second gripping member is designed to mesh with the modified at least one gripping means receiving notch on the first gripping member. In the Preferred Embodiment, one modified at least one gripping means and one modified at least one gripping means receiving notch are concentrically arranged on the gripping surface of the first gripping member and on the gripping surface of the second gripping member.

The new and novel curtain suspension device is constructed from a semi-rigid, resilient material allowing the end and the opposite end of the curved member to be moved apart by simultaneously moving a first arm and a second arm of the curved member away from one another, thereby separating the first gripping member and the second gripping member. Opening the curtain suspension device in this manner allows the curtain suspension device to be placed around a prior art support bar or rod. Additionally, opening the curtain suspension device allows a prior art curtain, drape or other sheet-like material to be positioned between the first gripping member and the second gripping member so that the new and novel curtain suspension device can be closed in a gripping position on the prior art curtain, drape or other sheet-like material.

An engaging means having engaging arms separated by a groove is continuously formed on a gripping surface of the first gripping member and centrally located on and projecting outwardly and away from the gripping surface of the first gripping member. Engaging surfaces are distally and continuously formed on the engaging arms opposite the intersection of the engaging means and the gripping surface of the first gripping member. In the Preferred Embodiment, the engaging surfaces are angled toward the gripping surface of the first gripping member.

An engaging means receptacle is centrally disposed through the second gripping member and allows the engaging means of the first gripping member to removably engage the second gripping member. The engaging means of the first gripping member is designed to pass through an at least one opening of a prior art shower curtain and then through the engaging means receptacle of the second gripping member. The engaging surfaces of the engaging means have been designed to protrude outwardly away from the distal end of the engaging means so that the distance from an outermost edge of one engaging surface to an outermost edge the other engaging surface is slightly greater than the diameter of the engaging means receptacle. Thus, as the engaging means is disposed though the engaging means receptacle, the engaging arms are forced toward one another temporarily closing the groove that separates them.

Once the engaging means has been completely disposed through the engaging means receptacle, the resilient nature of the new and novel curtain suspension device allows the engaging arms of the engaging means to move away from one another, returning to their original positions, so that the engaging surfaces of the engaging arms contact a retaining surface on the outer surface of the second gripping member surrounding the engaging means receptacle. Pressure exerted against the gripping surface of the first gripping member and the gripping surface of the second gripping member, by the presence of a prior art shower curtain positioned between the first gripping member and the second gripping member, causes the engaging surfaces of the first gripping member to exert pressure against the retaining surface of the second gripping member, thereby removably engaging the second gripping member.

When the new and novel curtain suspension device is in a closed gripping position around a prior art shower curtain, the at least one gripping means of the first gripping member forces the prior art shower curtain into the at least one gripping means receiving notch of the second gripping member and the at least one gripping means of the second gripping member alternately forces the prior art shower curtain into the at least one gripping means receiving notch of the first gripping member. Thus, the prior art shower curtain is firmly gripped by the curtain suspension device.

Weight of a prior art shower curtain produces a downward force relative to the prior art support bar or rod which produces stress on the at least one opening of a prior art shower curtain when other types of prior art devices are used to suspend a prior art shower curtain from a prior art support bar. The concentric arrangement of the at least one gripping means and the at least one gripping means receiving notch distributes the weight of a suspended prior art shower curtain away from and evenly around the at least one opening of a prior art shower curtain preventing tearing, ripping, splitting and undue wear of the prior art shower curtain. The new and novel curtain suspension device provides firm non-destructive gripping for a variety of prior art curtains, drapes and other sheet-like material when suspending prior art curtains, drapes and other sheet-like material from a support bar or rod.

Weight of a prior art shower curtain also causes a downward force on the curtain suspension device which acts on the curtain suspension device where the curved member of the curtain suspension device contacts a prior art support bar or rod. A friction reducing means is continuously formed on the inner surface of the curved member and is comprised of diametrically opposed converging angled sides whose intersection forms an apex. In the preferred embodiment, the converging sides are angled downward toward a central axis of the friction reducing means so that the apex is oriented away from the inner surface of the curved member and toward the first gripping member and the second gripping member. In another embodiment, the sides of the friction reducing means are diametrically opposed downwardly converging curved sides. The curved sides are concave, the concavity being oriented toward a central axis of the friction reducing means so that the apex is oriented away from the inner surface of the curved member and toward the first gripping member and the second gripping member.

The apex of the friction reducing means contacts the surface of a prior art support bar or rod resulting in significantly less surface area contacting the prior art support bar than if the inner surface of the curved member were to contact the prior art support bar. Thus, frictional resistance produced as the curtain suspension device is moved along the prior art support bar is minimized.

Prior art support bars or rods are typically constructed having an inner tube designed to fit into an outer tube of a slightly larger diameter. This construction allows a prior art support bar to be adjusted to a desired length. Thus, the surface of the inner tube is lower than the surface of the outer tube creating an obstruction, where an edge of the outer tube encompasses the inner tube, over which the curtain suspension device must slide when the prior art shower curtain is pulled along the support bar to an open or closed position. The diametrically opposed converging angled sides of the friction reducing means minimizes the contact area of the curtain suspension device with such obstructions on a prior art support bar or rod. Additionally, the angled nature of the sides allow the curtain suspension device to easily slide up and over the obstruction. Since the sides are diametrically opposed and symmetrical, the new and novel curtain suspension device will easily overcome obstructions inherent in prior art support bars or rods despite the location of the obstruction in relation to the directional movement of the curtain suspension device.

To achieve the foregoing and other advantages, the present invention provides a new and novel curtain suspension device designed to prevent tearing, ripping, splitting, and undue wear of suspended curtains, drapes or other sheet-like materials, that moves easily and freely along a support bar or rod and that easily overcomes inherent obstructions present on prior art support bars or rods without undue stress on the suspended curtain, drape or other sheet-like material.

The more important features of the present invention have been broadly outlined in order that the detailed description thereof that follows may be better understood and in order that the present contribution to the art may be better appreciated. There are additional features of the invention that will be more fully described hereinafter and which, together with the features outlined above, will form the subject matter of the claims appended hereto. Those skilled in the art will appreciate that the conception, upon which the present disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory review the nature and essence of the technical disclosure of the application. The abstract is neither intended to define the invention of the application, which is measured by the claims, nor is it intended to be limiting as to the scope of the invention in any way.

Accordingly, it is an object and advantage of the invention to provide a new and novel curtain suspension device that prevents tearing, ripping, splitting, and undue wear of suspended curtains, drapes or other sheet-like materials.

Another object and advantage of the invention is to provide a new and novel curtain suspension device that is easily and freely movable along a support bar or rod.

Another object and advantage of the invention is to provide a new and novel curtain suspension device that easily overcomes obstructions inherent in adjustable prior art support bars or rods.

Another object and advantage of the invention is to provide a new and novel curtain suspension device that quickly and easily removably grips a curtain, drape or other sheet-like material.

Another object and advantage of the invention is to provide a new and novel curtain suspension device that is quickly and easily removed from a curtain, drape or other sheet-like material.

Still another object and advantage of the invention is to provide a new and novel curtain suspension device which may be easily and efficiently manufactured and marketed.

Yet another object and advantage of the invention is to provide a new and novel curtain suspension device which is of durable and reliable construction.

These and other objects and advantages will become apparent from review of the drawings and from a study of the Description of the Preferred Embodiment relating to the drawings which has been provided by way of illustration only.

DESCRIPTION OF THE PREFERRED EMBODIMENT

Figure 1:
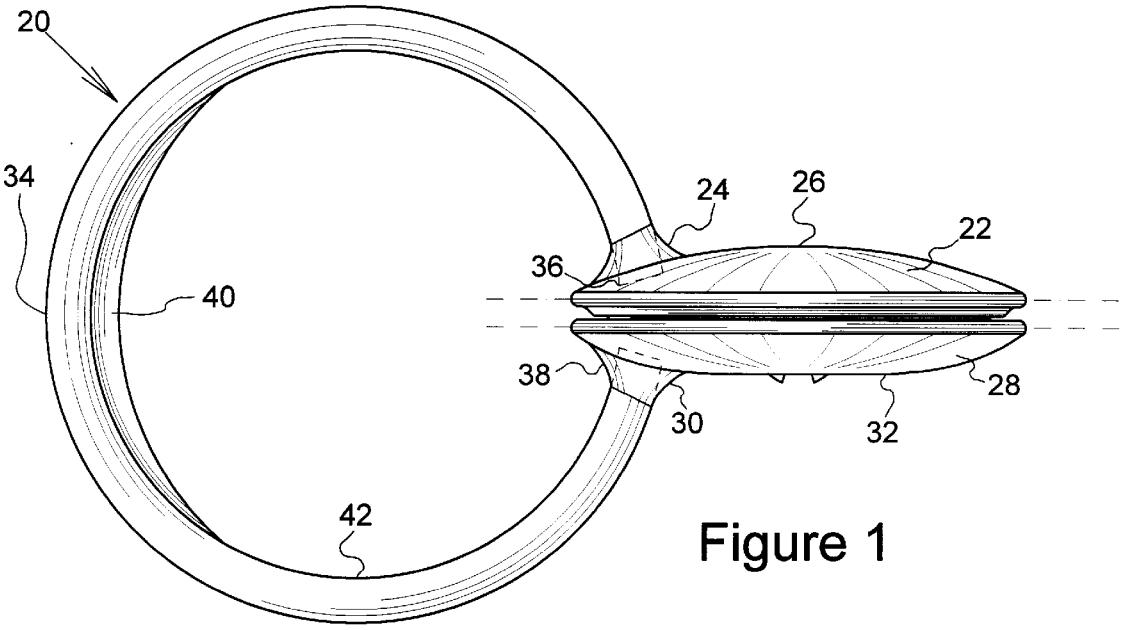
FIG. 1 is a side view of the new and novel curtain suspension device in a closed position.

Referring to the drawings in general, the present description is given in the context of the new and novel curtain suspension device as utilized to suspend a prior art shower curtain from a prior art shower curtain bar. It will be readily apparent to those skilled in the art that the usefulness of the present invention is not limited to this application and that changes could be made in construction and should be considered to be within the spirit and scope of the present invention.

Referring now in particular to FIG. 1 of the drawings, there is shown a side view of the new and novel curtain suspension device, shown generally by the numeral 20. The new and novel curtain suspension device 20 has been designed to be utilized with a variety of prior art curtains, drapes and other sheet-like material when suspending prior art curtains, drapes and other sheet-like material from a bar or rod to provide a barrier or for decorative purposes. FIG. 1 of the drawings illustrates the curtain suspension device 20 in a closed position. In the Preferred Embodiment, applicant's new and novel curtain suspension device 20 is constructed from semi-rigid, resilient plastic, plastic polymers, rubber, Teflon® and the like. Other semi-rigid materials may also be used and are considered to be within the spirit and scope of the applicant's invention.

First gripping member 22 has continuously formed thereon receiving means 24, the receiving means 24 being continuously formed on outer surface 26 of the first gripping member 22. First gripping member 22 is semi-ellipsoidal in shape having a circular shape through a planar axis of the first gripping member 22 illustrated by a dot-dashed line in FIG. 1 of the drawings. The receiving means 24 is positioned on the outer surface 26 of the first gripping member 22 near the circumference of the first gripping member 22. Second gripping member 28 also has continuously formed thereon receiving means 30, the receiving means 30 being continuously formed on outer surface 32 of the second gripping member 28. Second gripping member 28 is also semi-ellipsoidal in shape having a circular shape through a planar axis of the second gripping member 28 illustrated by a dot-dashed line in FIG. 1 of the drawings. The receiving means 30 is positioned on the outer surface 32 of the second gripping member 28 near the circumference of the second gripping member 28. In the Preferred Embodiment, the receiving means 24 and 30 are continuously formed on outer surface 26 and on outer surface 32, respectively, by injection molding, molding, die-cutting or other methods of continuous formation known in the art. Other methods of continuous formation known in the art may also be used and are considered to be within the spirit and scope of the present invention.

Curved member 34 is generally circular in shape having an end 36 and an opposite end 38. The end 36 and the opposite end 38 of the curved member 34 are shown in dashed lines in FIG. 1 of the drawings for purposes of clarity. The receiving means 24 on outer surface 26 of the first gripping member 22 is designed to encompass the end 36 of the curved member 34 and the receiving means 30 on outer surface 32 of the second gripping member 28 is designed to encompass the opposite end 38 of the second gripping member 28. In the Preferred Embodiment, the end 36 and the opposite end 38 are fixedly attached in the receiving means 24 and 30, respectively, using an adhesive. Other known attaching means may also be used and are considered to be within the spirit and scope of the invention. In another embodiment, the end 36 and the opposite end 38 are continuously formed with receiving means 24 and 30, respectively, by molding, injection molding, die-cutting or other methods of continuous formation techniques known in the art.

Friction reducing means 40 is continuously formed on inner surface 42 of the curved member 34 opposite the end 36 and the opposite end 38 of the curved member 34. In the Preferred Embodiment, the friction reducing means 40 has been designed to allow the new and novel curtain suspension device 20 to move easily along a prior art support bar or rod, the prior art support bar not shown in FIG. 1 of the drawings for purposes of clarity. The friction reducing means 40 will be discussed more fully hereinafter.

Figure 2:
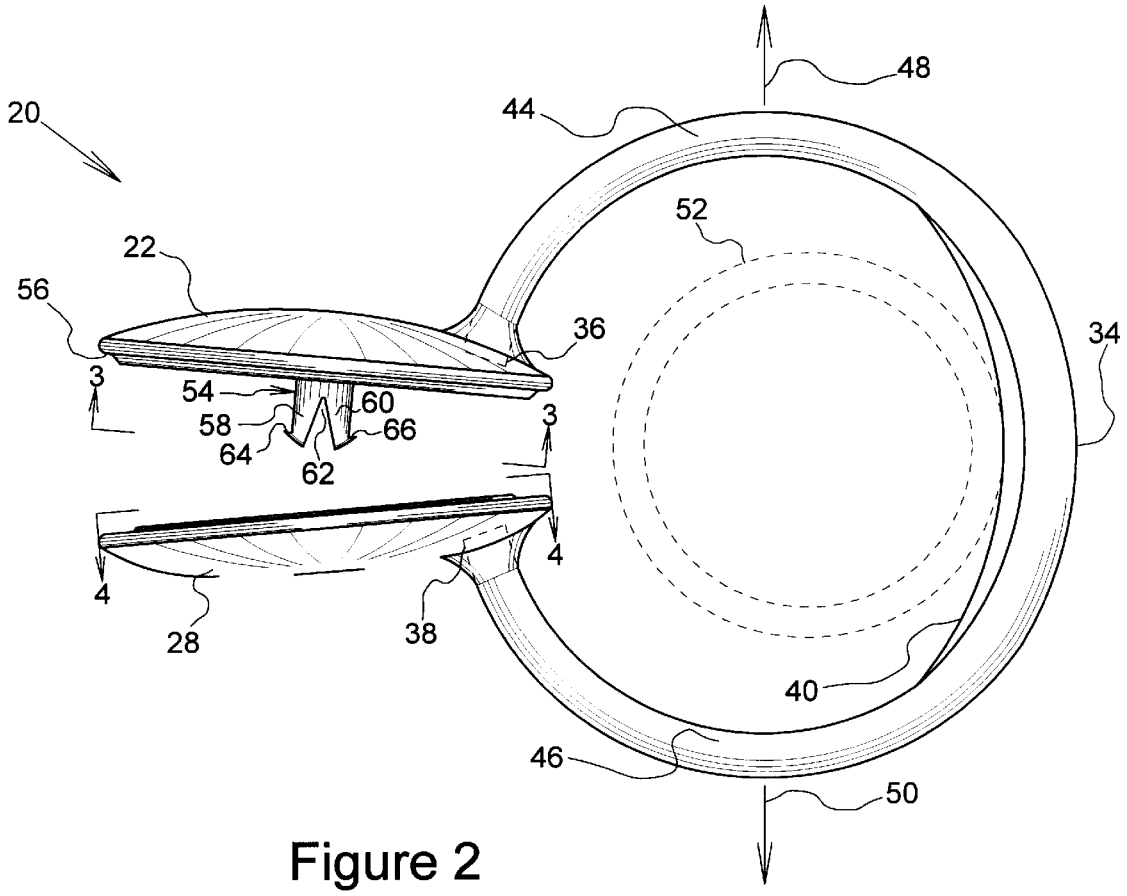
FIG. 2 is a side view of the new and novel curtain suspension device in an open position.

Referring now to FIG. 2 of the drawings there is shown a side view of the new and novel curtain suspension device, shown generally by the numeral 20. FIG. 2 of the drawings illustrates the curtain suspension device 20 in an open position. The semi-rigid nature of the curtain suspension device 20 allows end 36 and opposite end 38 of the curved member 34 to be moved apart by simultaneously moving first arm 44 and second arm 46 in the direction of the arrows 48 and 50 respectively, thereby opening the curtain suspension device 20 and separating the first gripping member 22 and the second gripping member 28. The end 36 and the opposite end 38 are shown in dashed lines in FIG. 2 for purposes of clarity. Once the first gripping member 22 and the second gripping member 28 have been separated, the curtain suspension device 20 is placed around a prior art support bar or rod 52 so that friction reducing means 40 of the curtain suspension device 20 rests on the prior art support bar or rod 52, the prior art support bar 52 being shown in a dashed line in FIG. 2 of the drawings for purposes of clarity. Additionally, opening the curtain suspension device 20 allows a prior art curtain, drape or other sheet-like material to be positioned between the first gripping member 22 and the second gripping member 28 so that the new and novel curtain suspension device 20 can be closed in a gripping position on the prior art curtain, drape or other sheet-like material, the prior art curtain, drape or other sheet-like material not shown in FIG. 2 for purposes of clarity, but clearly shown in FIGS. 5, 6, 9 10 and 11 of the drawings.

Still referring to FIG. 2 of the drawings, there is shown engaging means, shown generally by the numeral 54, continuously formed on gripping surface 56 of the first gripping member 22. The engaging means 54 is centrally located on the gripping surface 56 of the first gripping member 22 and projects outwardly and away from the gripping surface 56 of the first gripping member 22. Engaging arms 58 and 60 are separated by groove 62, the groove 62 being generally V-shaped and allowing the engaging arms 58 and 60 to be pressed toward one another. Engaging surfaces 64 and 66 are distally continuously formed on engaging arms 58 and 60, respectively, opposite the intersection of the engaging means 54 and the gripping surface 56 of the first gripping member 22. In the Preferred Embodiment, the engaging surfaces 64 and 66 are angled toward the gripping surface 56 of the first gripping member 22. Other configurations may also be used and are considered to be within the spirit and scope of the present invention. Movement of the engaging arms 58 and 60 toward one another allows the engaging means 54 to be disposed through the second gripping member 28, thereby removably engaging the second gripping member 28, and will be discussed more fully hereinafter.

Figure 3:
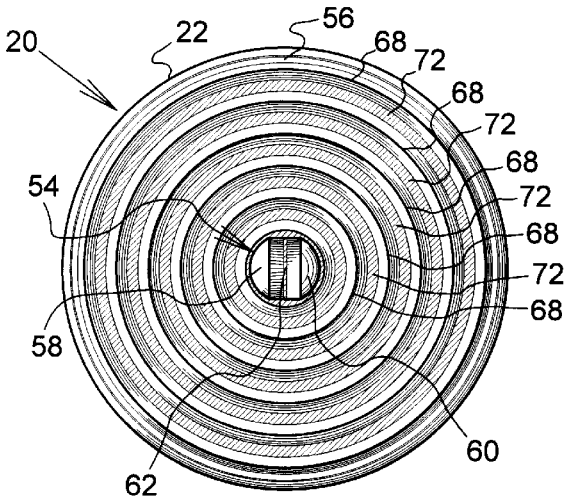
FIG. 3 is a plan view of the new and novel curtain suspension device taken along lines 3—3 of FIG. 2 of the drawings.
Figure 4:
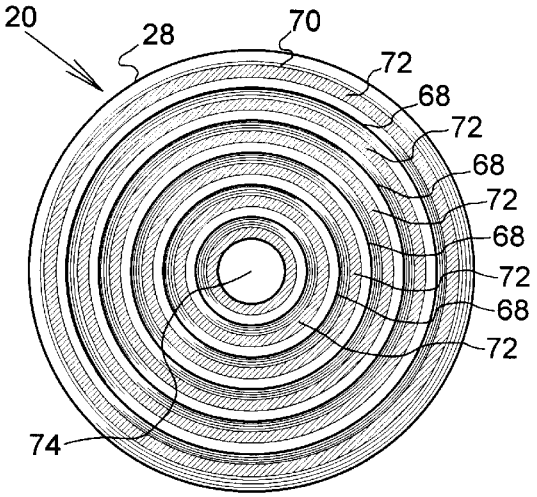
FIG. 4 is a plan view of the new and novel curtain suspension device taken along lines 4—4 of FIG. 2 of the drawings.

Referring now in general to FIGS. 3 and 4 of the drawings there is shown at least one gripping means 68 continuously formed on gripping surface 56 of the first gripping member 22 and continuously formed on gripping surface 70 of the second gripping member 28. FIG. 3 is a plan view of the new and novel curtain suspension device 20 taken along lines 3—3 of FIG. 2 of the drawings. FIG. 4 is a plan view of the new and novel curtain suspension device 20 taken along lines 4—4 of FIG. 2 of the drawings. FIGS. 3 and 4 also illustrate the circular shape of the first gripping member 22 and the second gripping member 28, respectively, through the planar axis illustrated by dot-dashed lines in FIG. 1 of the drawings.

Still referring to FIGS. 3 and 4 of the drawings, the at least one gripping means 68 protrudes from the gripping surfaces 56 and 70 of the first gripping member 22 and the second gripping member 28, respectively, having a generally inverted V-shape. At least one gripping means receiving notch 72 is continuously formed in gripping surfaces 56 and 70 of the first gripping member 22 and the second gripping member 28, respectively, the at least one gripping means receiving notch 72 being generally U-shaped. The at least one gripping means 68 is concentrically arranged on the gripping surfaces 56 and 70 of the first gripping member 22 and the second gripping member 28, respectively, perpendicular to and around a central axis of the first gripping member 22 and perpendicular to and around a central axis of the second gripping member 28, respectively. Similarly, the at least one gripping means receiving notch 72 is concentrically arranged on the gripping surfaces 56 and 70 of the first gripping member 22 and the second gripping member 28, respectively, perpendicular to and around a central axis of the first gripping member 22 and perpendicular to and around a central axis of the second gripping member 28, respectively.

The at least one gripping means 68 formed on the gripping surface 56 of the first gripping member 22 is concentrically arranged to locate directly opposite the at least one gripping means receiving notch 72 formed in the gripping surface 70 of the second gripping member 28 and the at least one gripping means 68 formed on the gripping surface 70 of the second gripping member 28 is concentrically arranged to locate directly opposite the at least one gripping means receiving notch 72 formed in the gripping surface 56 of the first gripping member 22. That is, the arrangement of the at least one gripping means 68 on the first gripping member 22 is designed to mesh with the at least one gripping means receiving notch 72 on the second gripping member 28, while the at least one gripping means 68 on the second gripping member 28 is designed to mesh with the at least one gripping means receiving notch 72 on the first gripping member 22.

In the Preferred Embodiment, a plurality of at least one gripping means 68 are concentrically spaced apart on the gripping surface 56 of the first gripping member 22 and on the gripping surface 70 of the second gripping member 28 and a plurality of at least one gripping means receiving notches 72 are formed in the gripping surface 56 of the first gripping member 22 and in the gripping surface 70 of the second gripping member 28 between successive concentric at least one gripping means 68. That is, the at least one gripping means 68 and the at least one gripping means receiving notch 72 are alternately arranged concentrically on the gripping surface 56 of the first gripping member 22 and on the gripping surface 70 of the second gripping member 28. The plurality of at least one gripping means 68 and the plurality of at least one gripping means receiving notch 72 are designed to be concentrically oppositely arranged on the first gripping member 22 and the second gripping member 28 as previously described. Other pluralities and configurations may also be used and are considered to be within the spirit and scope of the present invention.

Referring in particular now to FIG. 4 of the drawings, there is also shown engaging means receptacle 74 centrally disposed through second gripping member 28. The engaging means receptacle 74 is a bore centrally disposed through the second gripping member 28 and allows the engaging means 54 to removably engage the second gripping member 28 thereby removably securing the first gripping member 22 to the second gripping member 28. The engaging means 54 is not shown in FIG. 4 but is clearly shown in FIGS. 2, 3, 5, 6, 9 and 10 of the drawings.

Figure 5:
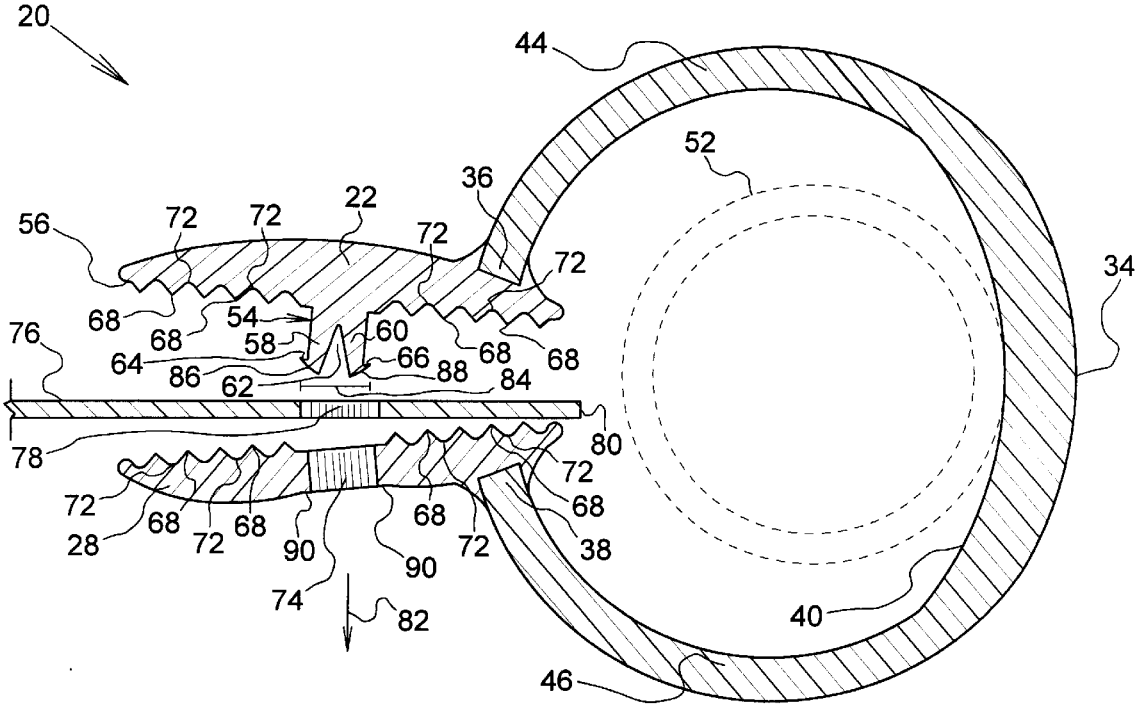
FIG. 5 is a cross sectional side view of the new and novel curtain suspension device in an open position around a prior art shower curtain.

Referring now to FIG. 5 of the drawings, there is shown a cross sectional side view of the new and novel curtain suspension device 20 in an open position with a prior art shower curtain 76 positioned between the first gripping member 22 and the second gripping member 28. FIG. 5 is a cross sectional side view of FIG. 2 of the drawings which does not show the prior art shower curtain 76, the prior art shower curtain 76 being shown in FIG. 5 for purposes of clarity.

At least one opening 78 is positioned near upper edge 80 of a prior art shower curtain 76. The engaging means 54, centrally located on and projecting from the gripping surface 56 of the first gripping member 22, is designed to pass through the at least one opening 78 of the prior art shower curtain 76 and then through the engaging means receptacle 74 of the second gripping member 28 in the direction of the arrow 82. The distance 84 from an outermost edge of the engaging surface 64 to an outermost edge of the engaging surface 66 has been designed to be greater than the diameter of the engaging means receptacle 74. Thus, as the engaging means 54 is removably disposed though the engaging means receptacle 74 in the direction of the arrow 82, the curved surfaces 86 and 88 of the engaging arms 58 and 60, respectively, cause the engaging arms 58 and 60 of the engaging means 54 to move toward one another temporarily closing the groove 62.

Figure 6:
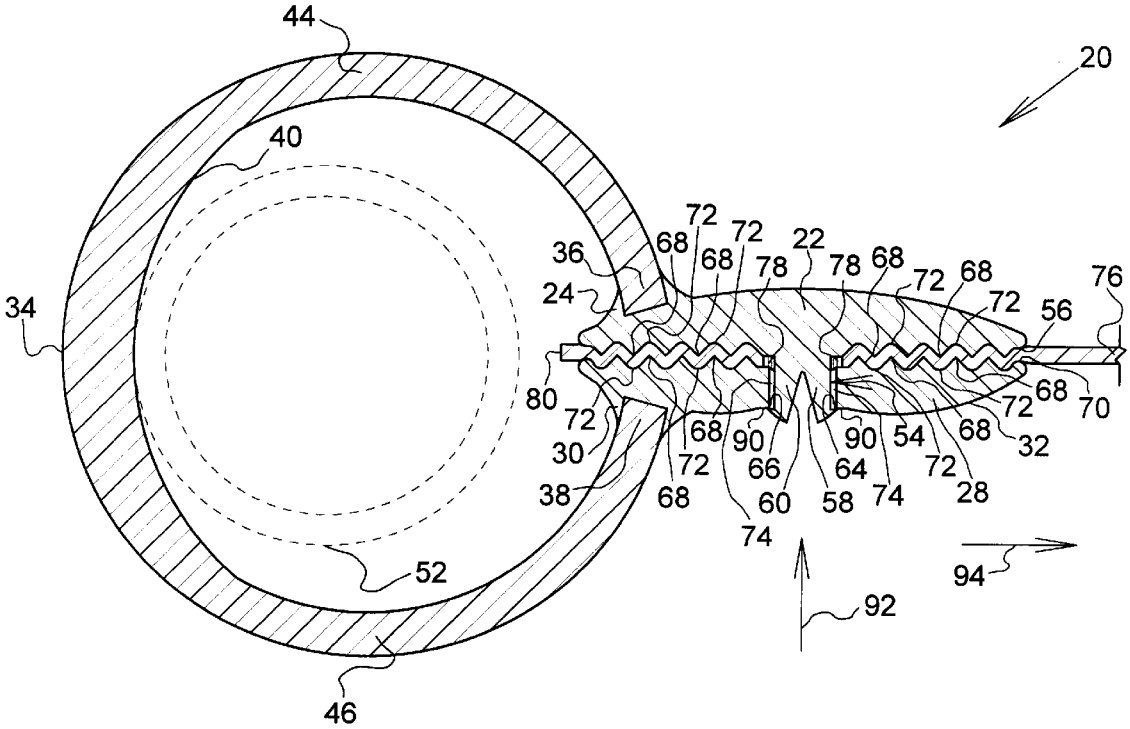
FIG. 6 is a cross sectional side view of the new and novel curtain suspension device in a closed gripping position around a prior art shower curtain.

Referring now to FIG. 6 of the drawings, there is shown a cross sectional side view of the new and novel curtain suspension device 20 in a closed position around a prior art shower curtain 76, the prior art shower curtain 76 removably engaged between the first gripping member 22 and the second gripping member 28. FIG. 6 is a cross sectional side view of FIG. 1 of the drawings which does not show the prior art shower curtain 76, the prior art shower curtain 76 being shown in FIG. 6 for purposes of clarity.

Once the engaging means 54 has been completely disposed through the engaging means receptacle 74, the resilient nature of the new and novel curtain suspension device 20 allows the engaging arms 58 and 60 of the engaging means 54 to move away from one another, returning to their original positions, so that the engaging surfaces 64 and 66 of the engaging arms 58 and 60, respectively, contact retaining surface 90. The retaining surface 90 is a flat portion of the outer surface 32 of the second gripping member 28 surrounding the engaging means receptacle 74. The retaining surface 90 is more clearly seen in FIG. 5 of the drawings. Still referring to FIG. 6 of the drawings, since the engaging surfaces 64 and 66 are angled toward the gripping surface 56 of the first gripping member 22, as previously described, pressure exerted against the gripping surface 56 of the first gripping member 22 and the gripping surface 70 of the second gripping member 28 by the presence of the prior art shower curtain 76 causes the engaging surfaces 64 and 66 to exert pressure against the retaining surface 90 in the direction of the arrow 92 thereby removably engaging the retaining surface 90 and thereby removably engaging the second gripping member 28.

When the new and novel curtain suspension device 20 is in a closed position around a prior art shower curtain 76 as shown in FIG. 6 of the drawings, the at least one gripping means 68 of the first gripping member 22 forces the prior art shower curtain 76 into the at least one gripping means receiving notch 72 of the second gripping member 28 and the at least one gripping means 68 of the second gripping member 28 alternately forces the prior art shower curtain 76 into the at least one gripping means receiving notch 72 of the first gripping member 22. Thus, the prior art shower curtain 76 is firmly and removably gripped by the curtain suspension device 20. The curtain suspension device 20 can be easily removed from the prior art shower curtain 76 by pressing the engaging arm 58 and the engaging arm 60 toward one another and then applying pressure to the engaging means 54 in the direction of the arrow 92.

Weight of the prior art shower curtain 76 produces a downward force relative to the prior art support bar or rod 52 in the direction of the arrow 94 which produces stress on the at least one opening 78 of the prior art shower curtain 76 when other types of prior art devices are used to suspend a prior art shower curtain 76 from a prior art support bar 52. The concentric arrangement of the at least one gripping means 68 and the at least one gripping means receiving notch 72 on the gripping surfaces 56 and 70 of the first gripping member 22 and the second gripping member 28, respectively, provides a firm non-destructive grip on the surface of the prior art shower curtain 76 around the at least one opening 78 of the prior art shower curtain 76. Thus, the concentric arrangement of the at least one gripping means 68 and the at least one gripping means receiving notch 72 distributes the weight of a suspended prior art shower curtain 76 away from and evenly around the at least one opening 78 positioned near the upper edge 80 of a prior art shower curtain 76 preventing tearing, ripping, splitting and undue wear of the prior art shower curtain 76. The new and novel curtain suspension device 20 provides firm non-destructive gripping for a variety of prior art curtains, drapes and other sheet-like material when suspending prior art curtains, drapes and other sheet-like material from a support bar or rod. The prior art support bar or rod 52 is shown in dashed lines in FIGS. 5 and 6 of the drawings for purposes of illustration only.

Figure 7:
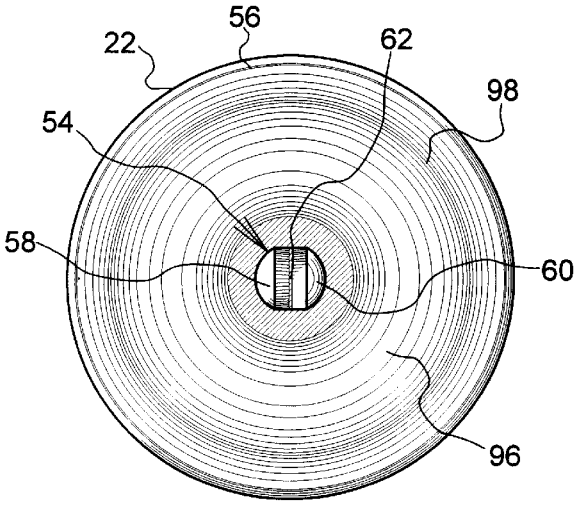
FIG. 7 is a plan view of the gripping surface of the first gripping member showing modified at least one gripping means and modified at least one gripping means receiving notch, similar to FIG. 3 of the drawings.
Figure 8:
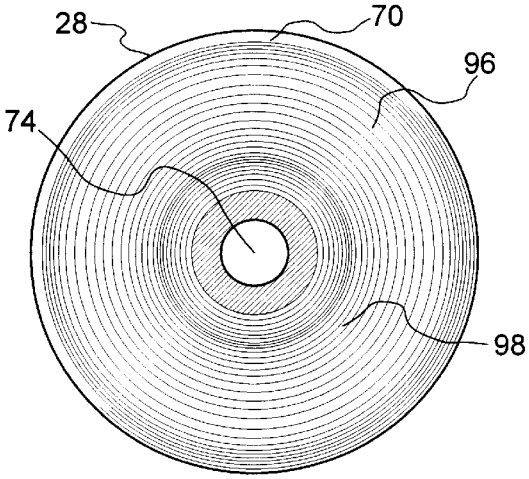
FIG. 8 is a plan view of the gripping surface of the second gripping member showing modified at least one gripping means and modified at least one gripping means receiving notch, similar to FIG. 4 of the drawings.
Figure 9:
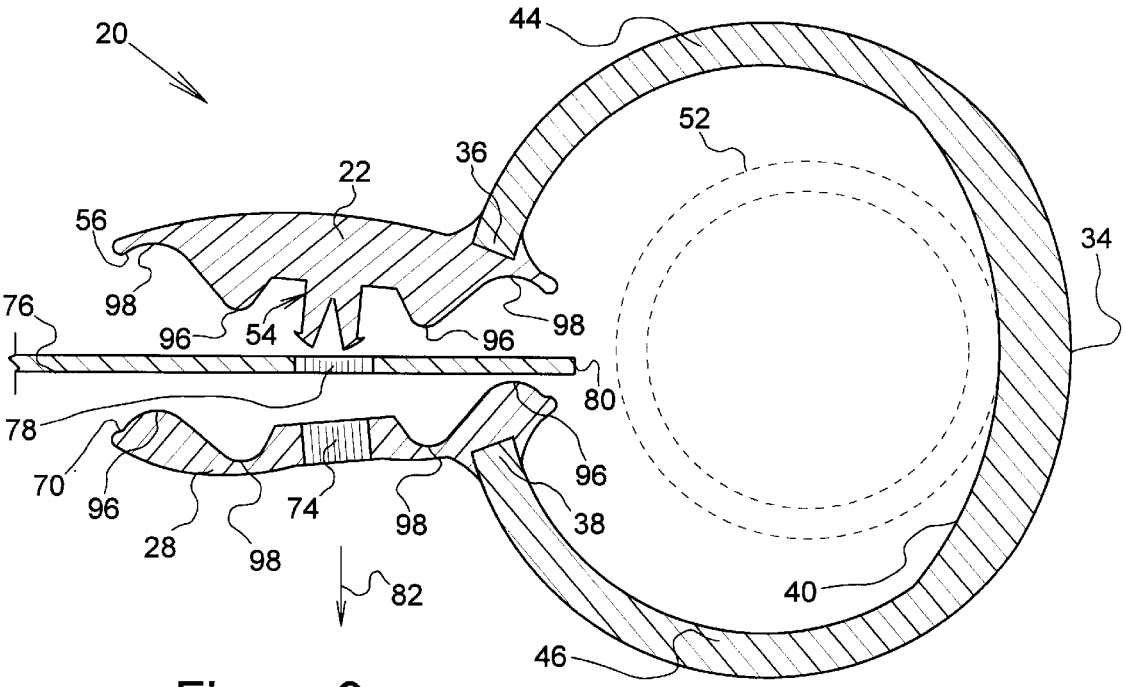
FIG. 9 is a cross sectional side view of the new and novel curtain suspension device, in an open position around a prior art shower curtain, showing modified at least one gripping means and modified at least one gripping means receiving notch.
Figure 10:
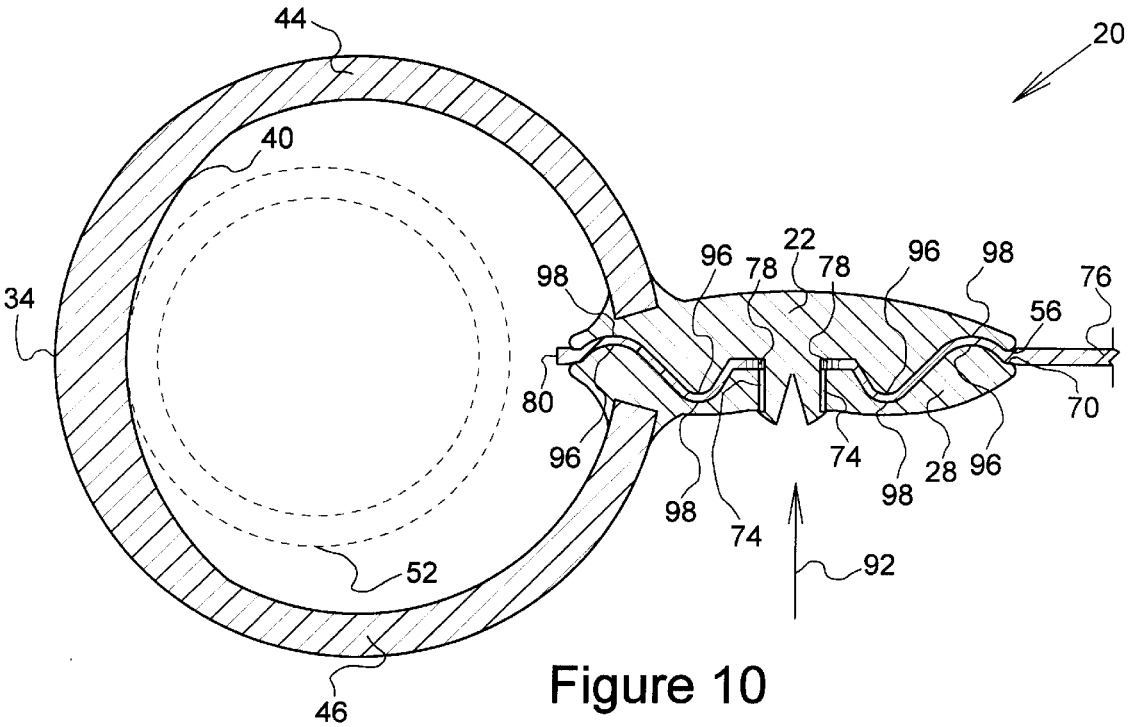
FIG. 10 is a cross sectional side view of the new and novel curtain suspension device, in a closed gripping position around a prior art shower curtain, showing modified at least one gripping means and modified at least one gripping means receiving notch.

Referring now in general to FIGS. 7, 8, 9 and 10 of the drawings there will be shown and described modified at least one gripping means 96 and modified at least one gripping means receiving notch 98 continuously formed in the gripping surface 56 of the first gripping member 22 and continuously formed in the gripping surface 70 of the second gripping member 28. FIG. 7 is a plan view of the gripping surface 56 of the first gripping member 22 similar to FIG. 3 of the drawings. FIG. 8 is a plan view of the gripping surface 70 of the second gripping member 28 similar to FIG. 4 of the drawings. FIG. 9 is a cross sectional side view of the new and novel curtain suspension device 20 in an open position with a prior art shower curtain 76 positioned between the modified at least one gripping means 96 and the modified at least one gripping means receiving notch 98 of the first gripping member 22 and of the second gripping member 28, similar to FIG. 5 of the drawings. FIG. 10 is a cross sectional side view of the new and novel curtain suspension device 20 in a closed gripping position with a prior art shower curtain 76 removably engaged between the modified at least one gripping means 96 and the modified at least one gripping means receiving notch 96 of the first gripping member 22 and of the second gripping member 28, similar to FIG. 6 of the drawings.

Referring now in particular to FIGS. 7 and 8 of the drawings, there is shown modified at least one gripping means 96 protruding outwardly from the gripping surfaces 56 and 70 of the first gripping member 22 and the second gripping member 28, respectively, having a generally inverted U-shape. Modified at least one gripping means receiving notch 98 is generally U-shape and is continuously formed in gripping surfaces 56 and 70 of the first gripping member 22 and the second gripping member 28, respectively. The modified at least one gripping means 96 and the modified at least one gripping means receiving notch 98 are concentrically arranged on the gripping surfaces 56 and 70 of the first gripping member 22 and the second gripping member 28, respectively, perpendicular to and around a central axis of the first gripping member 22 and perpendicular to and around a central axis of the second gripping member 28, respectively.

The modified at least one gripping means 96 formed on the gripping surface 56 of the first gripping member 22 is concentrically arranged to locate directly opposite the modified at least one gripping means receiving notch 98 formed in the gripping surface 70 of the second gripping member 28 and the modified at least one gripping means 96 formed on the gripping surface 70 of the second gripping member 28 is concentrically arranged to locate directly opposite the modified at least one gripping means receiving notch 98 formed in the gripping surface 56 of the first gripping member 22. That is, the arrangement of the modified at least one gripping means 96 on the first gripping member 22 is designed to mesh with the modified at least one gripping means receiving notch 98 on the second gripping member 28, while the modified at least one gripping means 96 on the second gripping member 28 is designed to mesh with the modified at least one gripping means receiving notch 98 on the first gripping member 22.

In the Preferred Embodiment, one modified at least one gripping means 96 and one modified at least one gripping means receiving notch 98 are concentrically and oppositely arranged on the gripping surface 56 of the first gripping member 22 and on the gripping surface 70 of the second gripping member 28. Other numbers and configurations may also be used and are considered to be within the spirit and scope of the present invention.

Referring now to FIG. 9 of the drawings, there is shown a cross sectional side view of the new and novel curtain suspension device 20 in an open position with a prior art shower curtain 76 positioned between the modified at least one gripping means 96 and the modified at least one gripping means receiving notch 98 of the first gripping member 22 and of the second gripping member 28, similar to FIG. 5 of the drawings. At least one opening 78 is positioned near upper edge 80 of a prior art shower curtain 76 as previously described. The engaging means 54, centrally located on and projecting from the gripping surface 56 of the first gripping member 22, is designed to pass through the at least one opening 78 of the prior art shower curtain 76 and then through the engaging means receptacle 74 of the second gripping member 28 in the direction of the arrow 82 to removably engage the second gripping member 28 as previously described.

Referring now to FIG. 10 of the drawings, there is shown a cross sectional side view of the new and novel curtain suspension device 20 in a closed position with a prior art shower curtain 76 removably engaged between the modified at least one gripping means 96 and the modified at least one gripping means receiving notch 98 of the first gripping member 22 and of the second gripping member 28, similar to FIG. 6 of the drawings. When the new and novel curtain suspension device 20 is in a closed position around a prior art shower curtain 76, as previously described and as also shown in FIG. 10 of the drawings, the modified at least one gripping means 96 of the first gripping member 22 forces the prior art shower curtain 76 into the modified at least one gripping means receiving notch 98 of the second gripping member 28 and the modified at least one gripping means 96 of the second gripping member 28 forces the prior art shower curtain 76 into the modified at least one gripping means receiving notch 98 of the first gripping member 22. Thus, the prior art shower curtain 76 is firmly and removably gripped by the curtain suspension device 20.

The general U-shape of the modified at least one gripping means 96 and the modified at least one gripping means receiving notch 98 is particularly useful when delicate prior art curtains, drapes and other sheet-like material are being suspending from a bar or rod. The U-shape of the modified at least one gripping means 96 along with the opposing concentric arrangement of the modified at least one gripping means 96 and the modified at least one gripping means receiving notch 98 on the gripping surfaces 56 and 70 of the first gripping member 22 and the second gripping member 28, respectively, provides a firm non-destructive grip on delicate prior art curtains, drapes and other sheet-like material. The concentric arrangement of the modified at least one gripping means 96 and the modified at least one gripping means receiving notch 98 also distributes the weight of delicate prior art curtains, drapes and other sheet-like material away from and evenly around the at least one opening 78, positioned near the upper edge 80, of a prior art curtain, drape or other sheet-like material, preventing tearing, ripping, splitting and undue wear of delicate prior art curtains, drapes or other sheet-like materials.

Figure 11:
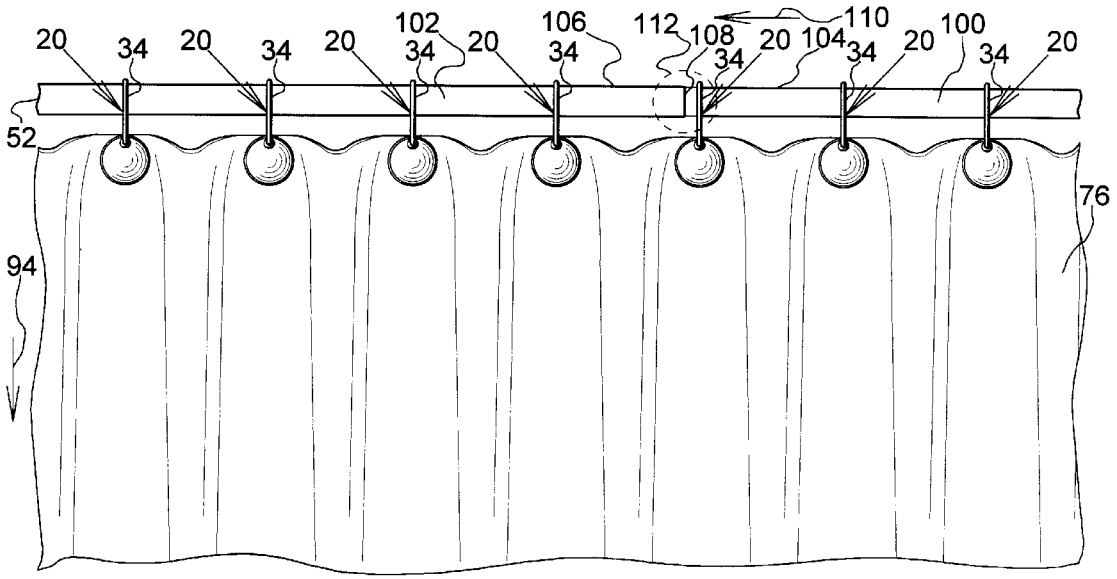
FIG. 11 is a front view of a plurality of new and novel curtain suspension devices movably encompassing a prior art support bar and suspending a prior art shower curtain from the prior art support bar.

Referring now to FIG. 11 of the drawings, there is shown a prior art shower curtain 76 suspended from a prior art support bar, shown generally by the numeral 52, utilizing the new and novel curtain suspension device 20. FIG. 11 is a front view of a plurality of curtain suspension devices 20 movably encompassing a prior art support bar 52 and suspending a prior art shower curtain 76 from the prior art support bar 52. It is to be understood that the prior art shower curtain 76 and prior art support bar 52 shown in FIG. 11 of the drawings are for purposes of illustration only and the present description is given for purposes of illustration only. It will be readily apparent to those skilled in the art that the usefulness of the present invention is not limited to this application and that changes could be made in construction and should be considered to be within the spirit and scope of the present invention.

A prior art support bar or rod 52 is typically attached at each end to a wall, walls or other structures which are not shown in FIG. 11 for purposes of clarity. A plurality of new and novel curtain suspension devices 20 movably encompass the prior art support bar or rod 52, as previously described, and removably engage a prior art shower curtain 76 to suspend the prior art shower curtain 76 from a prior art support bar 52. The weight of the prior art shower curtain 76 produces a downward force in the direction of the arrow 94 which produces stress on the at least one opening 78 of the prior art shower curtain 76 as previously described. The at least one opening 78 cannot be seen in FIG. 11 but is clearly shown in FIGS. 5, 6, 9 and 10 of the drawings.

Still referring to FIG. 11 of the drawings, the downward force shown by the arrow 94 also acts on the curtain suspension device 20 where the curved member 34 of the curtain suspension device 20 contacts the prior art support bar 52. Prior art support bars or rods are typically constructed having an inner tube 100 designed to fit into an outer tube 102 of a slightly larger diameter. This constructions allows a prior art support bar 52 to be adjusted to a desired length. Thus, the surface 104 of the inner tube 100 is lower than the surface 106 of the outer tube 102 creating an obstruction, where an edge 108 of the outer tube 102 encompasses the inner tube 100, over which the curtain suspension device 20 must slide when the prior art shower curtain 76 is pulled in the direction of the arrow 110. The downward force 94 on the prior art shower curtain 76, and thus, on a suspension device to which the prior art shower curtain 76 is attached, can increase the difficulty of moving other types of prior art suspension devices over such obstructions and can cause other types of prior art suspension devices to hang on the edge 108 of the outer tube 102. This often results in the tearing, ripping or undue wear of the prior art shower curtain 76. The new and novel curtain suspension device 20 utilizes a unique friction reducing means 40 to overcome this difficulty, the friction reducing means 40 not seen in FIG. 11 but further illustrated in the enlarged cross sectional view of FIG. 12 of the drawings, the view indicated by the dashed circle 112 in FIG. 11, and described more fully hereinafter.

Figure 12:
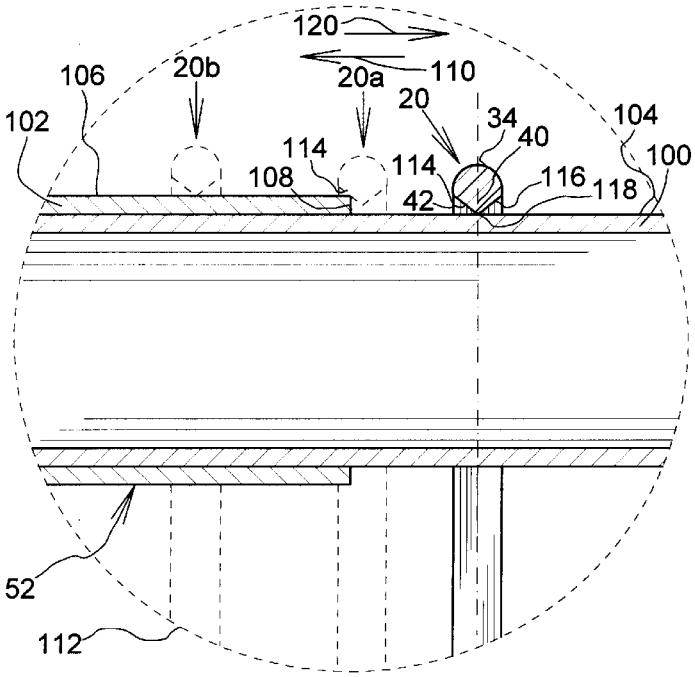
FIG. 12 is an enlarged cross sectional view of a portion of the new and novel curtain suspension device and illustrates the new and novel curtain suspension device in alternate positions on a prior art support bar.

Referring now to FIG. 12 of the drawings, there is shown and will be described the friction reducing means 40 which allows the new and novel curtain suspension device 20 to move freely and easily over obstructions encountered along the surfaces 104 and 106 of a prior art support bar 52 such as the edge 108 of the outer tube 102 of the prior art support bar 52. FIG. 12 is an enlarged cross sectional view of the curtain suspension device 20 shown by the dashed circle 112 in FIG. 11. FIG. 12 also illustrates the new and novel curtain suspension device 20 in alternate positions along a prior art support bar 52. Alternate positions of a curtain suspension device 20, as it moves along a prior art support bar 52 in the direction of the arrow 110, are shown in dashed lines in FIG. 12 for purposes of clarity and are provided for purposes of illustration only.

In the Preferred Embodiment and in FIG. 12 of the drawings, friction reducing means 40 is continuously formed on inner surface 42 of the curved member 34 as previously described. The friction reducing means 40 is comprised of diametrically opposed downwardly converging sides 114 and 116, the intersection of the first side 114 and the second side 116 forming an apex 118. Sides 114 and 116 are angled downward toward a central axis of the friction reducing means 40, the central axis illustrated by a dot-dashed line, so that the apex 118 is oriented away from the inner surface 42 of the curved member 34 and toward the first gripping member 22 and the second gripping member 28. The first gripping member 22 and the second gripping member 28 are not shown in FIG. 12 but are clearly shown in FIGS. 1, 2, 5, 6, 9 and 12 of the drawings.

Figure 13:
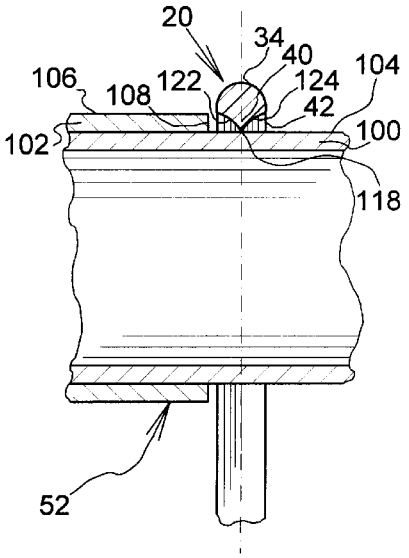
FIG. 13 is an enlarged cross sectional view of a portion of the new and novel curtain suspension device similar to FIG. 12 and illustrates another embodiment of the friction reducing means.

Referring briefly now to FIG. 13 of the drawings, there is shown another embodiment of the friction reducing means 40. FIG. 13 is an enlarged cross sectional view of the curtain suspension device 20 similar to FIG. 12 of the drawings and illustrates the friction reducing means 40 having curved sides, the curved sides shown by the numerals 122 and 124. The intersection of the diametrically opposed downwardly converging curved sides 122 and 124 form the apex 118. Curved sides 122 and 124 are concave, the concavity oriented toward a central axis of the friction reducing means 40, the central axis illustrated by a dot-dashed line, so that the apex 118 is oriented away from the inner surface 42 of the curved member 34 and toward the first gripping member 22 and the second gripping member 28. The first gripping member 22 and the second gripping member 28 not shown in FIG. 13 but clearly shown in FIGS. 1, 2, 5, 6, 9 and 12 of the drawings.

Referring back now to FIG. 12 of the drawings, it can be seen how the design of the friction reducing means 40, having an apex 118, results in significantly less surface area of the curtain suspension device 20 contacting the prior art support bar 52 than if the inner surface 42 of the curved member 34 were to contact the prior art support bar 52. Thus, frictional resistance produced as the curtain suspension device 20 is moved along the prior art support bar 52 is minimized. As the curtain suspension device 20 is moved along the surface 104 of the inner tube 100 of the prior art support bar 52 in the direction of arrow 110, the new and novel curtain suspension device 20 may encounter an edge 108 of the outer tube 102, as shown by curtain suspension device 20*a*. The side 114 of the friction reducing means 40 minimizes the surface area contact of the curtain suspension device 20 with the edge 108 of the outer tube 102. Additionally, the angled nature of the side 114 allows the curtain suspension device 20 to easily slide up and over the edge 108 to a position on the outer tube 102 as indicated by the curtain suspension device 20*b*.

Since the side 114 and the side 116 are diametrically opposed and symmetrical, the new and novel curtain suspension device 20 will move easily and freely along the prior art support bar 52 in either the direction of the arrow 110 or in the direction of the arrow 120. That is, side 116 functions in the same manner as side 114, as previously described, to minimize surface area contact of the curtain suspension device 20 with obstructions on a prior art support bar 52. Friction reducing means 40 having diametrically opposed converging curved sides 122 and 124, as shown in FIG. 13 of the drawings, functions in the same manner to overcome obstructions on a prior art support bar 52. Thus, the new and novel curtain suspension device 20 will easily overcome obstructions inherent in prior art support bars or rods despite the location of the obstruction in relation to the directional movement of the curtain suspension device 20 thereby preventing tearing, ripping and undue wear of prior art curtains, drapes and other sheet-like material when suspending prior art curtains, drapes and other sheet-like material from a bar or rod to provide a barrier or for decorative purposes.

From the above it can be seen that the new and novel curtain suspension device accomplishes all of the objects and advantages presented herein before. Nevertheless it is within the spirit and scope of the invention that changes in the basic curtain suspension device may be made and the Preferred Embodiment and the modifications shown and described herein have only been given by way of illustration.

Having described my invention, I claim:

1. A curtain suspension device for suspending curtains, drapes and other sheet-like material from a support bar to provide a barrier or for decorative purposes, the curtains, drapes and other sheet-like material having at least one opening positioned near an upper edge, the curtain suspension device comprising:

a. a curved member having an end, an opposite end, and an inner surface;

b. a first gripping member having an outer surface and a gripping surface, the end of the curved member fixedly attached to the outer surface of the first gripping member;

c. a second gripping member having an outer surface and a gripping surface, the opposite end of the curved member fixedly attached to the outer surface of the second gripping member, wherein the gripping surface of the second gripping member and the gripping surface of the first gripping member are oriented toward one another;

d. at least one gripping means concentrically formed on the gripping surface of the first gripping member and opposingly concentrically formed on the gripping surface of the second gripping member;

e. at least one gripping means receiving notch concentrically formed in the gripping surface of the first gripping member and opposingly concentrically formed in the gripping surface of the second gripping member, the at least one gripping means receiving notch being U-shaped, wherein the at least one gripping means receiving notch is alternately formed between the at least one gripping means;

f. engaging means centrally formed on the gripping surface of the first gripping member, the engaging means protruding away from the gripping surface of the first gripping member; and g. an engaging means receptacle centrally disposed through the second gripping member, wherein the engaging means of the first gripping member is disposed through the engaging means receptacle, the first gripping member thereby removably engaging the second gripping member, the curtain suspension device thereby removably engaging a prior art curtain, drape or other sheet-like material positioned between the first gripping member and the second gripping member.

2. The curtain suspension device as defined in claim 1 wherein the at least one gripping means is generally V-shaped.

3. The curtain suspension device as defined in claim 1 wherein the at least one gripping means is generally U-shaped.

4. The curtain suspension device as defined in claim 1 wherein a plurality of at least one gripping means are concentrically arranged on the gripping surface of the first gripping member and opposingly concentrically arranged on the gripping surface of the second gripping member.

5. The curtain suspension device as defined in claim 1 wherein a plurality of at least one gripping means receiving notch are concentrically arranged in the gripping surface of the first gripping member and opposingly concentrically arranged in the gripping surface of the second gripping member.

6. The curtain suspension device as defined in claim 1 wherein the inner surface of the curved member has continuously formed thereon friction reducing means, the friction reducing means oriented away from the inner surface and toward the end and the opposite end of the curved member.

7. The curtain suspension device as defined in claim 1 wherein the end of the curved member is continuously formed with the outer surface of the first gripping member and the opposite end of the curved member is continuously formed with the outer surface of the second gripping member.

8. A curtain suspension device for suspending curtains, drapes and other sheet-like material from a support bar to provide a barrier or for decorative purposes, the curtains, drapes and other sheet-like material having at least one opening positioned near an upper edge, the curtain suspension device comprising:

a. a curved member having an end, an opposite end, and an inner surface;

b. a first gripping member having an outer surface, a gripping surface and a circumference, wherein receiving means are formed on the outer surface of the first gripping member near the circumference of the first gripping member, the receiving means encompassing the end of the curved member, the end of the curved member being fixedly attached in the receiving means;

c. a second gripping member having an outer surface, a gripping surface and a circumference, wherein receiving means are formed on the outer surface of the second gripping member near the circumference of the second gripping member, the receiving means encompassing the opposite end of the curved member, the opposite end of the curved member being fixedly attached in the receiving means;

d. at least one gripping means concentrically formed on the gripping surface of the first gripping member and opposingly concentrically formed on the gripping surface of the second gripping member;

e. at least one gripping means receiving notch concentrically formed in the gripping surface of the first gripping member and opposingly concentrically formed in the gripping surface of the second gripping member, the at least one gripping means receiving notch being U-shaped, wherein the at least one gripping means receiving notch is alternately formed between the at least one gripping means;

f. engaging means centrally formed on the gripping surface of the first gripping member, the engaging means protruding away from the gripping surface of the first gripping member; and g. an engaging means receptacle centrally disposed through the second gripping member, wherein the engaging means of the first gripping member is disposed through the engaging means receptacle, the first gripping member thereby removably engaging the second gripping member, the curtain suspension device thereby removably engaging a prior art curtain, drape or other sheet-like material positioned between the first gripping member and the second gripping member.

9. The curtain suspension device as defined in claim 8 wherein the at least one gripping means is generally V-shaped.

10. The curtain suspension device as defined in claim 8 wherein the at least one gripping means is generally U-shaped.

11. The curtain suspension device as defined in claim 8 wherein a plurality of at least one gripping means are concentrically arranged on the gripping surface of the first gripping member and opposingly concentrically arranged on the gripping surface of the second gripping member.

12. The curtain suspension device as defined in claim 8 wherein a plurality of at least one gripping means receiving notch are concentrically arranged in the gripping surface of the first gripping member and opposingly concentrically arranged in the gripping surface of the second gripping member.

13. The curtain suspension device as defined in claim 8 wherein the inner surface of the curved member has continuously formed thereon friction reducing means, the friction reducing means oriented away from the inner surface and toward the end and the opposite end of the curved member.

14. The curtain suspension device as defined in claim 8 wherein the end of the curved member is continuously formed with the outer surface of the first gripping member and the opposite end of the curved member is continuously formed with the outer surface of the second gripping member.

15. A curtain suspension device for suspending curtains, drapes and other sheet-like material from a support bar to provide a barrier or for decorative purposes, the curtains, drapes and other sheet-like material having at least one opening positioned near an upper edge, the curtain suspension device comprising:

a. a curved member having an end, an opposite end, and an inner surface;

b. a first gripping member having an outer surface, a gripping surface and a circumference, wherein receiving means are formed on the outer surface of the first gripping member near the circumference of the first gripping member, the receiving means encompassing the end of the curved member, the end of the curved member being fixedly attached in the receiving means;

c. a second gripping member having an outer surface, a gripping surface and a circumference, wherein receiving means are formed on the outer surface of the second gripping member near the circumference of the second gripping member, the receiving means encompassing the opposite end of the curved member, the opposite end of the curved member being fixedly attached in the receiving means;

d. at least one gripping means concentrically formed on the gripping surface of the first gripping member and opposingly concentrically formed on the gripping surface of the second gripping member;

e. at least one gripping means receiving notch concentrically formed in the gripping surface of the first gripping member and opposingly concentrically formed in the gripping surface of the second gripping member, the at least one gripping means receiving notch being U-shaped, wherein the at least one gripping means receiving notch is alternately formed between the at least one gripping means;

f. engaging means having engaging arms, the engaging means continuously formed on the gripping surface of the first gripping member, the engaging means centrally located on and projecting outwardly and away from the gripping surface of the first gripping member, wherein engaging surfaces are distally and continuously formed on the engaging arms opposite the intersection of the engaging means and the gripping surface of the first gripping member; and g. an engaging means receptacle centrally disposed through the second gripping member having a retaining surface surrounding the engaging means receptacle on the outer surface of the second gripping member, wherein the engaging means of the first gripping member is disposed through the engaging means receptacle, the engaging surfaces of the engaging arms removably engaging the retaining surface of the engaging means receptacle.

16. The curtain suspension device as defined in claim 15 wherein the at least one gripping means is generally V-shaped.

17. The curtain suspension device as defined in claim 15 wherein the at least one gripping means is generally U-shaped.

18. The curtain suspension device as defined in claim 15 wherein a plurality of at least one gripping means are concentrically arranged on the gripping surface of the first gripping member and opposingly concentrically arranged on the gripping surface of the second gripping member.

19. The curtain suspension device as defined in claim 15 wherein a plurality of at least one gripping means receiving notch are concentrically arranged in the gripping surface of the first gripping member and opposingly concentrically arranged in the gripping surface of the second gripping member.

20. The curtain suspension device as defined in claim 15 wherein the inner surface of the curved member has continuously formed thereon friction reducing means, the friction reducing means oriented away from the inner surface and toward the end and the opposite end of the curved member.

21. The curtain suspension device as defined in claim 15 wherein the end of the curved member is continuously formed with the outer surface of the first gripping member and the opposite end of the curved member is continuously formed with the outer surface of the second gripping member.

* * * * *